US012404665B2

(12) United States Patent
Zhan

(10) Patent No.: US 12,404,665 B2
(45) Date of Patent: Sep. 2, 2025

(54) STRAINER

(71) Applicant: Dongguan Zhicheng Supply Chain Co., Ltd., Dongguan (CN)

(72) Inventor: Jiaxing Zhan, Dongguan (CN)

(73) Assignee: Dongguan Zhicheng Supply Chain Co., Ltd., Dongguan (CN)

( * ) Notice: Subject to any disclaimer, the term of this patent is extended or adjusted under 35 U.S.C. 154(b) by 145 days.

(21) Appl. No.: 18/461,586

(22) Filed: Sep. 6, 2023

(65) Prior Publication Data

US 2024/0295106 A1 Sep. 5, 2024

(30) Foreign Application Priority Data

Mar. 3, 2023 (CN) ..... 202320390715.7

(51) Int. Cl.
*E03C 1/264* (2006.01)

(52) U.S. Cl.
CPC ..... *E03C 1/264* (2013.01)

(58) Field of Classification Search
CPC ..... E03C 1/264
USPC ..... D23/261
See application file for complete search history.

(56) References Cited

U.S. PATENT DOCUMENTS

| | | | | |
|---|---|---|---|---|
| 7,376,983 | B1 * | 5/2008 | Sciarrino | E03C 1/264 4/288 |
| D672,438 | S * | 12/2012 | Noel | D23/261 |
| D855,160 | S * | 7/2019 | Najimi | D23/261 |
| D941,441 | S * | 1/2022 | Ghiorghie | D23/261 |
| 2015/0275489 | A1 * | 10/2015 | Briggs | E03C 1/26 4/292 |

OTHER PUBLICATIONS

Www.metal-fabric.com; Boegger Industrial Limited; Metal Ring Mesh for Space Divider and Decoration date May 9, 2015 : Printed Mar. 25, 2025 (Year: 2015).*

* cited by examiner

*Primary Examiner* — Christine J Skubinna
(74) *Attorney, Agent, or Firm* — Best & Flanagan LLP

(57) ABSTRACT

The present invention relates to a sink strainer including a supporting plate and multiple annular chains. A drain hole is positioned at the center of the supporting plate. The annular chains are interconnected to form a mesh, with its outer edge connected to the supporting plate and surrounding the drain hole. The present invention effectively addresses the problem found in conventional non-reusable strainers.

7 Claims, 4 Drawing Sheets

STRAINER

FIELD OF INVENTION

The present invention relates to a sink strainer, and more specifically to a strainer that facilitates the removal of residues.

BACKGROUND OF THE INVENTION

During the daily cleaning process of a kitchen sink after washing fruits, vegetables, or cutlery, the resulting wastewater would inevitably carry a certain amount of vegetable leaves, peels, and other food residues. To mitigate the risk of these food remnants obstructing the drainpipe, it is a common practice to employ a strainer within the sink.

Reference is made to the Chinese Utility Model Patent Publication No. CN206873572U, which presents a common strainer design in prior art. This design primarily consists of a strainer body and a cylinder featuring numerous drain holes. However, the cylinder is to cleanse, as residues tend to become lodged within the drain holes. Clearing these residues demands the strainer to be vigorously shaken or even dislodged using an external implement, resulting in a degree of inconvenience. Addressing the aforementioned issue, Utility Model Patent Publication No. CN210369179U introduces a disposable strainer. Nonetheless, opting for frequent use of such disposable strainers inevitably results in an escalation of living costs and is not environmentally friendly.

Therefore, it is necessary to provide a technical solution to solve the abovementioned problems.

SUMMARY OF THE INVENTION

The present invention provides a strainer that facilitates the removal of residues and is intended to solve the problems of the prior art of not having a strainer that can be reused and facilitates the removal of residues in the strainer.

In order to achieve the above purpose, the present invention provides a strainer comprising a supporting plate and multiple annular chains, wherein: a drain hole is provided in the center of the supporting plate; and the annular chains are connected to each other to form a mesh, and an outer edge of the mesh is connected to the supporting plate, and the outer edge of the strainer surrounds the drain hole.

Wherein, the supporting plate is provided with multiple connection holes arranged in a circumferential array on an outside of the drain hole; and the annular chains located at the outer edge of the mesh extend through the corresponding connection holes respectively to connect the mesh to the supporting plate.

Wherein, the connection hole has a diameter ranging from 2 mm to 8 mm.

Wherein, each of the annular chains is in a circular shape and has a diameter ranging from 8 mm to 12 mm.

Wherein, an outer periphery of the supporting plate is provided with a transition portion, and an upper surface of the transition portion is in the form of a curved shape gradually inclined downward from an inside of the supporting plate to an outside of the supporting plate.

Wherein, the supporting plate is in a circular shape.

Wherein, the mesh comprises multiple annular chain sets arranged sequentially from an inside of the mesh to an outside of the mesh, and the annular chain sets comprise the annular chains arranged in a circumferential array and connected to each other; and each of the annular chain is engaged to the corresponding two annular chains in the annular chain set on the outside of the mesh.

Wherein, the mesh further comprises a center ring, and the annular chains in an innermost part of the annular chain sets are connected to the center ring.

The technical effects of the strainer in accordance with the present invention are as follows:

1. The strainer structure of the present invention comprises a series of interconnected annular chains. Consequently, as food residues are tipped out and dislodged during the straining process, each annular chain moves to the opposite side of the supporting plate under the influence of gravity. As these annular chains come to rest, the inertial effect triggers the dislodgement of residue adhering to the center of the annular chains. Moreover, as the annular chains collide, they induce vibrations that increase the separation between the residue and the annular chains. This vibration interaction enhances the effectiveness of the separation process. The present inventive design not only makes it easy to remove residue from the annular chains but also makes the strainer a reusable, non-disposable product. As a result, users' consumption costs are reduced.
2. In the present invention, the connection holes serve a dual purpose. In addition to their role in connecting the strainer, they also facilitate drainage distribution. When the strainer becomes clogged with food residue, the connection holes allow water to drain within the sink, enhancing overall drainage efficiency. This proactive measure not only improves drainage but also prevents sink clogs.

DETAILED DESCRIPTION OF THE PREFERRED EMBODIMENTS

Figure 1:
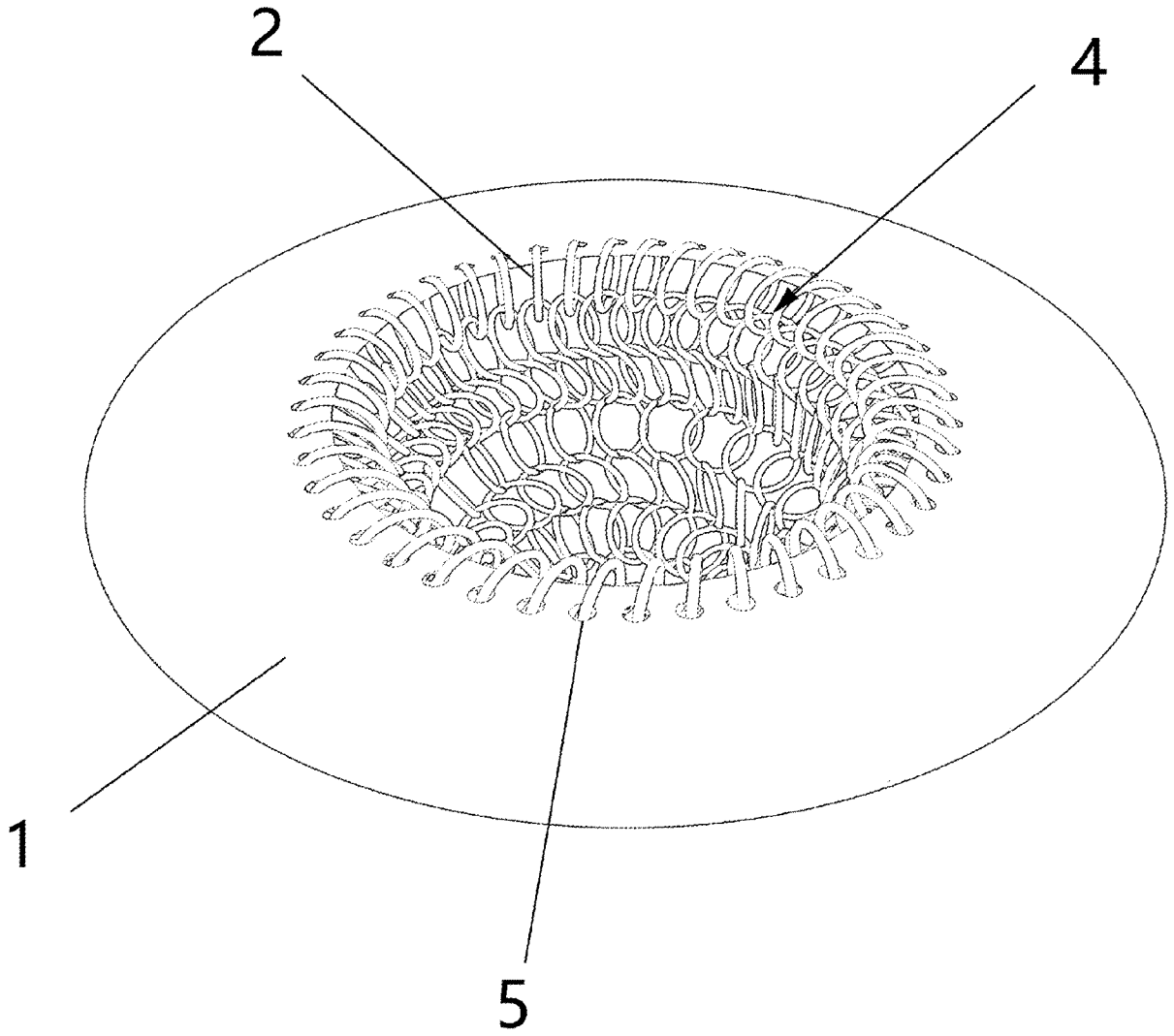
FIG. 1 is a schematic view of a strainer in accordance with the present invention.
Figure 2:
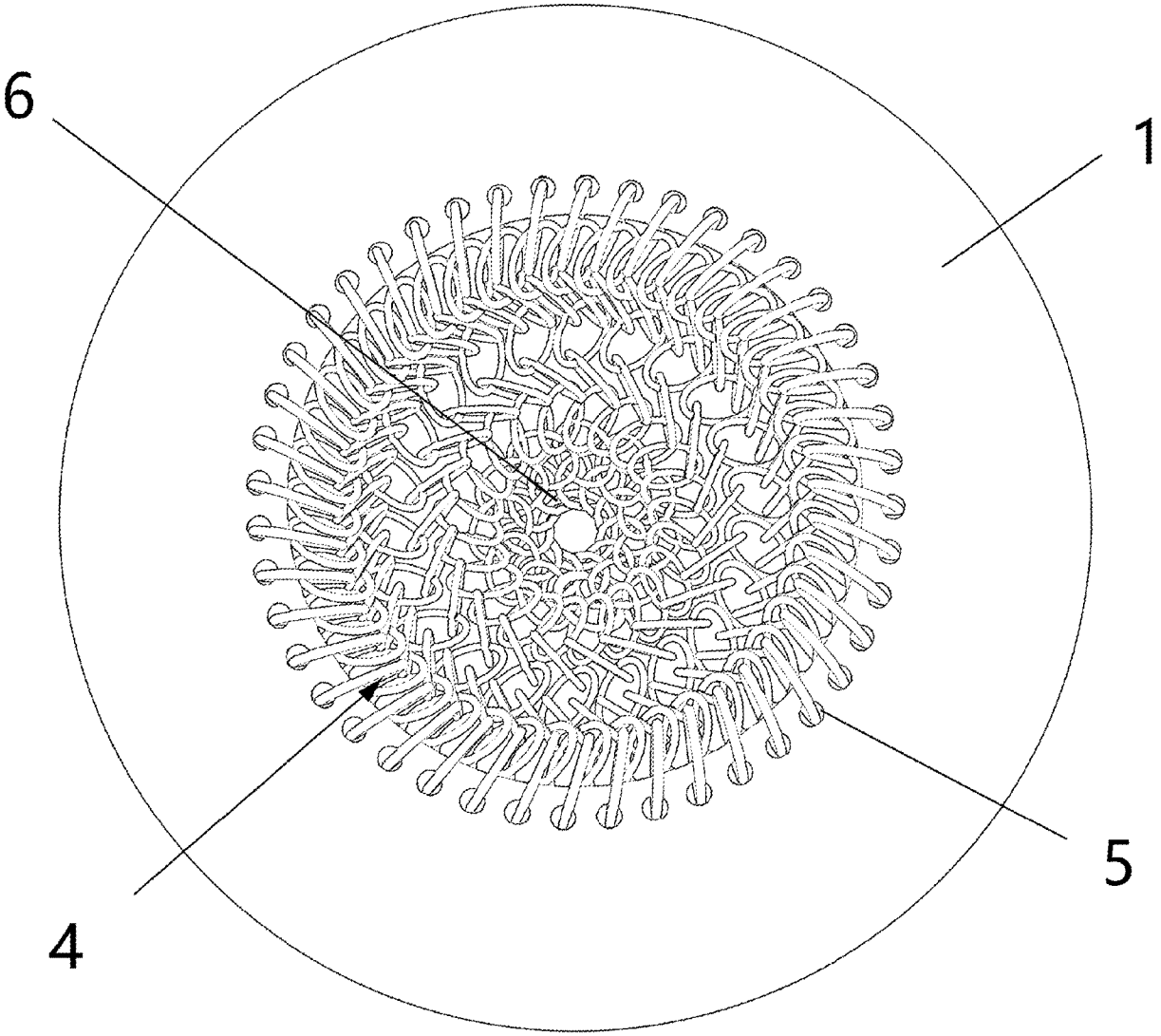
FIG. 2 is a top view of a strainer in accordance with the present invention.

In order that the purpose, technical solution, and advantages of the present invention may be more clearly understood, the present invention is described in further detail hereinafter in combination with the accompanying drawings and embodiments. It should be understood that the specific embodiments described herein serve only to interpret the present invention and are not intended to limit it.

It should be noted that when an element is referred to as being "fixed to" or "disposed on" another element, it may be attached directly to another element or maybe both with centering elements; and when an element is referred to as being "connected to" another element, it may be connected directly to another element or maybe both with centering elements.

Furthermore, the terms "first" and "second" are used for descriptive purposes only and are not intended to indicate or imply relative importance or to implicitly specify the number of technical features indicated. Thus, a feature defined by "first" or "second" may include one or more such features, either explicitly or implicitly. In the description of the present invention, "plurality" means two or more, unless otherwise expressly and specifically limited.

In the description of the present invention, it should be understood that orientation descriptions such as up, down, front, rear, left, right, top, bottom, in, out, and the like, which refer to orientation or positional relationships indicated as being based on those shown in the accompanying drawings, are intended only to facilitate the description of the present invention and to simplify the description, and do not indicate or suggest that the device or element referred to must have a particular orientation, be constructed and operated with a particular orientation, and therefore should not be construed as a limitation of the present invention.

In order to clearly illustrate the technical solution of the present invention, a preferred embodiment is provided below. With specific reference to FIGS. 1 to 4, a strainer that facilitates the removal of residues includes a supporting plate 1 and multiple annular chains 2, wherein:

- a drain hole 3 is provided in the center of the supporting plate 1;
- the annular chains 2 are connected to each other to form a mesh 4, an outer edge of the mesh 4 is connected to the supporting plate 1, and the outer edge of the mesh 4 surrounds the drain hole 3.

The mesh 4 facilitates the removal of residues in accordance with the present invention. The mesh 4 includes multiple interconnected annular chains 2. Consequently, as food residues are tipped out and dislodged during the straining process, each annular chain 2 moves to the opposite side of the supporting plate 1 under the influence of gravity. As these annular chains 2 come to rest, the inertial effect triggers the dislodgement of the food residues adhering to the center of the annular chains 2. Moreover, as the annular chains 2 collide with each other, the annular chains 2 induce vibrations that increase the separation between the food residues and the annular chains 2. This vibration enhances the effectiveness of the separation process. The strainer in accordance with this invention is not only easy for a user to remove residue in the annular chains 2 but also reusable. As a result, the user's consumption costs are reduced.

In this embodiment, the supporting plate 1 has multiple connection holes 5 arranged in a circumferential array on the outside of the drain hole 3; the annular chains 2 located at the outer edge of the mesh 4 extend through the corresponding connection holes 5, respectively, so as to enable the mesh 4 to be connected to the supporting plate 1. It should be noted that in a conventional strainer, when the conventional strainer is full of food residues, a sink becomes clogged and cannot be drained properly. When the conventional strainer is full of food residues, it is necessary to remove the food residues in the conventional strainer for several times, which greatly affects the user's experience. The connection holes 5 of this embodiment in accordance with the present invention not only connect to the mesh 4 of the strainer in accordance with this invention, the connection holes 5 also facilitate drainage. When the strainer becomes clogged with food residue, the connection holes 5 allow water within the sink to drain, enhancing overall drainage efficiency, improving drainage and preventing sink clogs. This ensures that the user only needs to clean the mesh 4 after washing all the food, and thus greatly improves the user experience.

In addition, a diameter of the connection hole 5 ranges from 2 mm to 8 mm. It should be noted that if the diameter of the connection hole 5 is too large, it will easily lead to larger food residues passing directly through the connection hole 5, resulting in clogging of a sewer connected to the sink.

In this embodiment, the annular chain 2 is in a circular shape and has a diameter ranging from 8 mm to 12 mm. It should be noted that if the diameter of the annular chain 2 is too small, it will be inconvenient for assembly of the annular chain 2, and if the diameter of the annular chain 2 is too large, it will easily lead to the larger food residues to pass directly through the annular chain 2, resulting in the clogging of the sewer connected to the sink.

Figure 3:
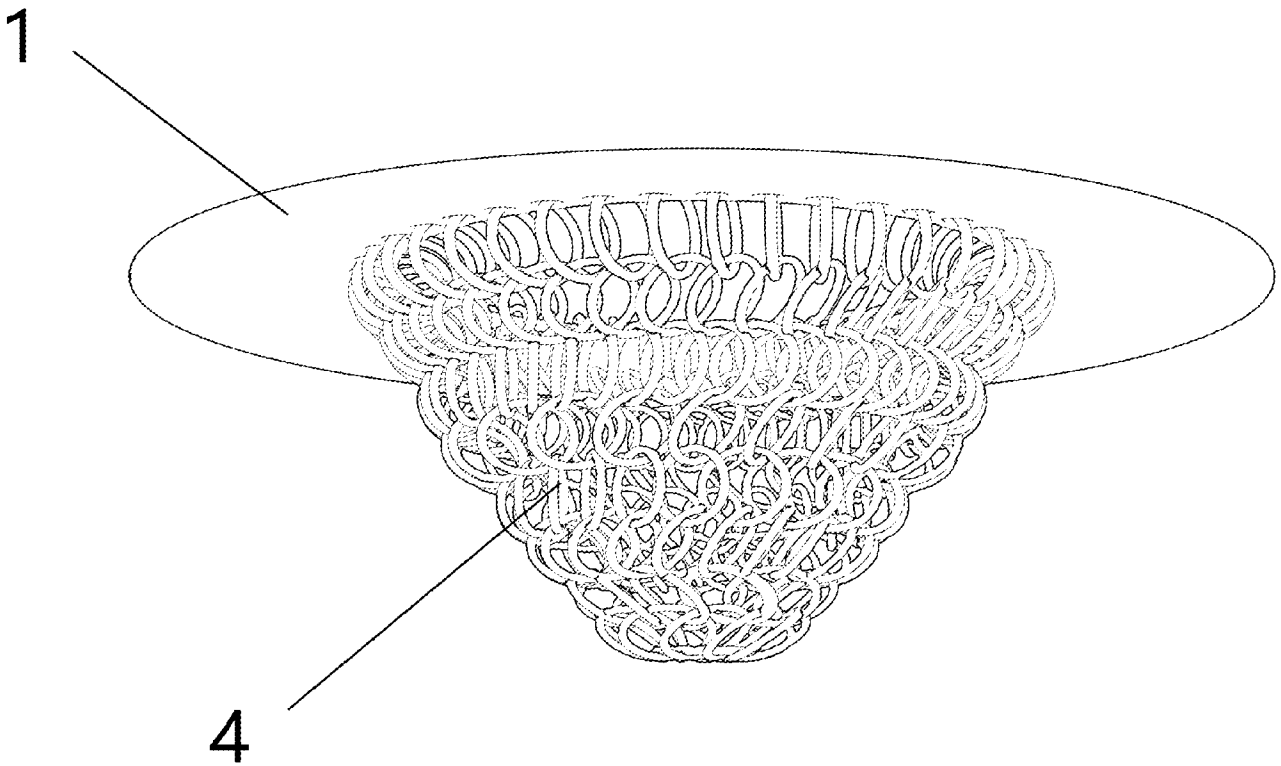
FIG. 3 is a side view of a strainer in accordance with the present invention.
Figure 4:
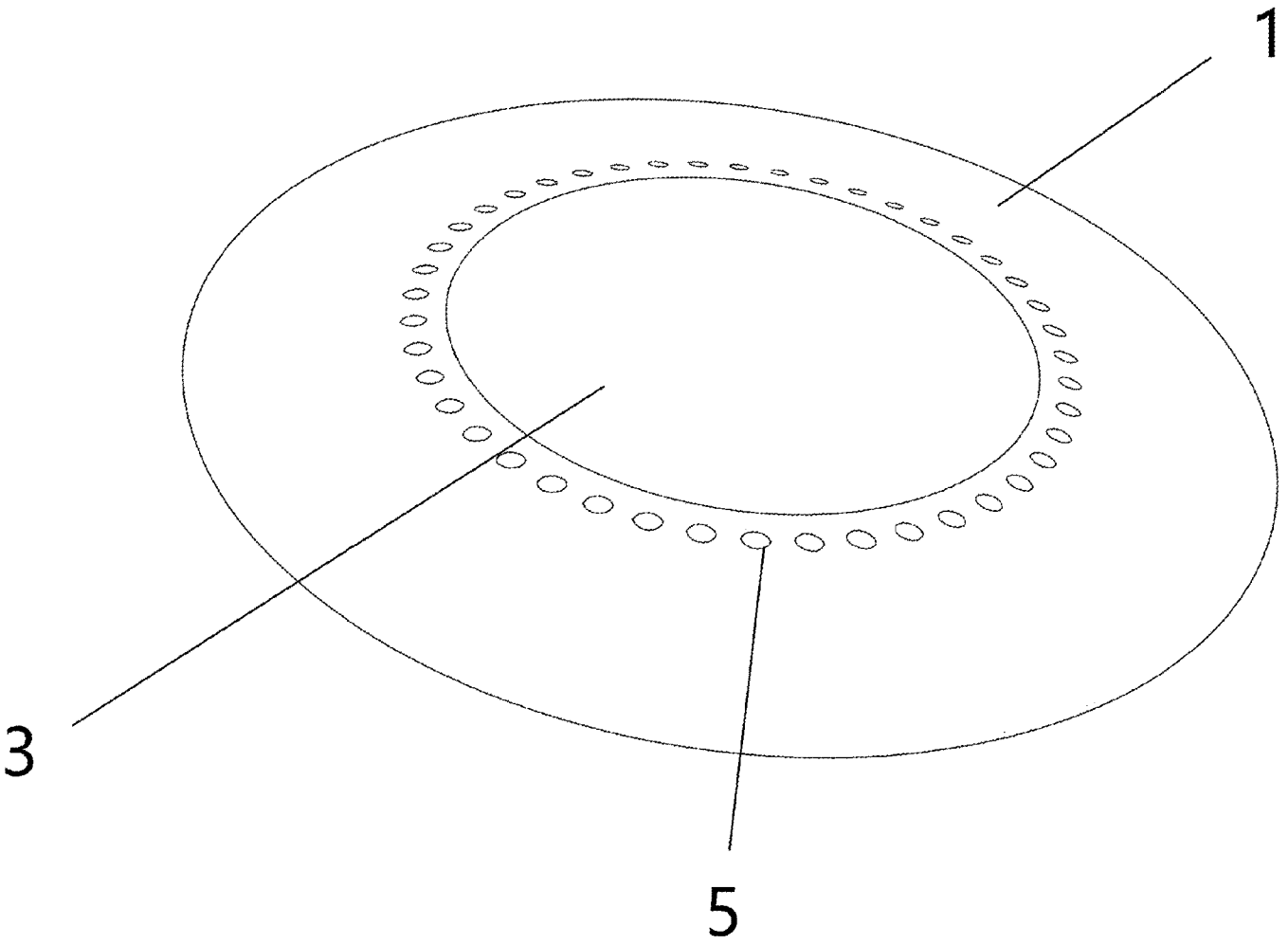
FIG. 4 is a schematic view of a supporting plate in the strainer in accordance with the present invention.

With reference to FIG. 3, in this embodiment, the supporting plate 1 is provided with a transition portion at an outer periphery, and an upper surface of the transition portion is in the form of a curved shape and is gradually inclined downward from an inside of the supporting plate 1 to an outside of the supporting plate 1. With the aforementioned design, an outer edge of the supporting plate 1 better fits the sink and prevent the food residues from getting stuck between the supporting plate 1 and the sink. In addition, the design makes the transition between the upper surface of the supporting plate 1 and a lower surface of the sink smooth, which allows the food residues to enter the drain hole 3 smoothly. As a further illustration, a center of the upper surface of the supporting plate 1 may be in a flat shape or a curved shape to be compatible with the transition portion.

Furthermore, the supporting plate 1 has a circular shape. Through the aforementioned design, the consumables of the supporting plate 1 are made relatively small under the premise of ensuring that the strainer is placed in a stable manner.

In this embodiment, the mesh 4 consists of multiple annular chain sets arranged sequentially from an inside of the mesh 4 to an outside of the mesh 4, and the annular chain sets include the multiple annular chains 2 arranged in a circumferential array and connected with each other; each of the annular chains 2 in the annular chain sets is connected to the corresponding two annular chains 2. With the above-mentioned design, the stability of the strainer is greatly improved.

Furthermore, the mesh 4 further comprises a center ring 6, wherein the annular chains 2 in an innermost part of the annular chain sets are connected to the center ring 6. It should be noted that because the annular chains 2 in the innermost part of the annular chain sets have certain degree of freedom to move, so without the center ring 6, when the annular chains 2 in the innermost part of the annular chain sets expand outwardly, a center of the mesh 4 produces a larger opening, which is likely to lead to the entry of larger food residues and cause clogging of the sewer. The presence of the center ring 6 restricts an expansion in the center of the mesh 4, which prevents larger food residues from passing through the center of the mesh 4.

The manufacturing steps of the strainer in accordance with the present invention are as follows:

- Step S1: making a steel wire and annealing the steel wire;
- Step S2: polishing the steel wire;
- Step S3: processing the steel wire into a annular chain 2 with an opening by means of a device;
- Step S4: connecting the annular chains 2 to each other and closing the openings of the annular chains 2 to form the mesh 4; and
- Step S5: extending the opening of the annular chains 2 located at a periphery of the mesh 4 through the connection holes 5 and closing the openings of the annular chains 2 to connect the mesh 4 to the supporting plate 1, thereby forming the strainer.

As a preferred embodiment, in step S3, the steel wire is processed by the device into multiple open annular chains 2 and multiple closed annular chains 2. In this way, the number of annular chains 2 that need to be subsequently processed for closure can be reduced, and the production efficiency can be improved.

The foregoing is only a preferred embodiment of the present invention, and the structure of which is not limited to the foregoing forms, and all modifications, equivalent substitutions and improvements made within the spirit and principles of the present invention are to be included within the scope of protection of the present invention.

What is claimed is:

1. A strainer comprising a supporting plate and multiple annular chains, wherein:

a drain hole is provided in the center of the supporting plate; and the annular chains are connected to each other to form a mesh, and an outer edge of the mesh is connected to the supporting plate, and the outer edge of the strainer surrounds the drain hole, wherein the supporting plate is provided with multiple connection holes arranged in a circumferential array on an outside of the drain hole; and the annular chains located at the outer edge of the mesh extend through the corresponding connection holes respectively to connect the mesh to the supporting plate.

2. The strainer according to claim 1, wherein the connection hole has a diameter ranging from 2 mm to 8 mm.

3. The strainer according to claim 1, wherein each of the annular chains is in a circular shape and has a diameter ranging from 8 mm to 12 mm.

4. The strainer according to claim 1, wherein an outer periphery of the supporting plate is provided with a transition portion, and an upper surface of the transition portion is in the form of a curved shape gradually inclined downward from an inside of the supporting plate to an outside of the supporting plate.

5. The strainer according to claim 1, wherein the supporting plate is in a circular shape.

6. A strainer comprising a supporting plate and multiple annular chains, wherein:

a drain hole is provided in the center of the supporting plate; and the annular chains are connected to each other to form a mesh, and an outer edge of the mesh is connected to the supporting plate, and the outer edge of the strainer surrounds the drain hole,, wherein the mesh comprises multiple annular chain sets arranged sequentially from an inside of the mesh to an outside of the mesh, and the annular chain sets comprise the annular chains arranged in a circumferential array and connected to each other; and each of the annular chain is engaged to the corresponding two annular chains in the annular chain set on the outside of the mesh.

7. The strainer according to claim 6, wherein the mesh further comprises a center ring, and the annular chains in an innermost part of the annular chain sets are connected to the center ring.

* * * * *